US010859092B2

(12) United States Patent
Sano et al.

(10) Patent No.: US 10,859,092 B2
(45) Date of Patent: Dec. 8, 2020

(54) IMPELLER AND ROTATING MACHINE

(71) Applicant: MITSUBISHI HEAVY INDUSTRIES, LTD., Tokyo (JP)

(72) Inventors: Takeshi Sano, Tokyo (JP); Masamichi Iino, Tokyo (JP); Keiichi Meguro, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 95 days.

(21) Appl. No.: 16/312,570

(22) PCT Filed: Oct. 20, 2017

(86) PCT No.: PCT/JP2017/038021
§ 371 (c)(1),
(2) Date: Dec. 21, 2018

(87) PCT Pub. No.: WO2018/074591
PCT Pub. Date: Apr. 26, 2018

(65) Prior Publication Data

US 2019/0211837 A1 Jul. 11, 2019

(30) Foreign Application Priority Data

Oct. 21, 2016 (JP) ..... 2016-206998

(51) Int. Cl.
*F04D 29/22* (2006.01)
*F04D 29/24* (2006.01)
*F04D 29/44* (2006.01)

(52) U.S. Cl.
CPC ..... *F04D 29/24* (2013.01); *F04D 29/2216* (2013.01); *F04D 29/2222* (2013.01); *F04D 29/44* (2013.01); *F04D 29/448* (2013.01)

(58) Field of Classification Search
CPC .. F04D 29/2216; F04D 29/2222; F04D 29/24; F04D 29/44; F04D 29/448
See application file for complete search history.

(56) References Cited

U.S. PATENT DOCUMENTS 4,093,401 A * 6/1978 Gravelle ..... F04D 29/284 415/143
5,002,461 A * 3/1991 Young ..... F04D 29/284 416/183

(Continued)

FOREIGN PATENT DOCUMENTS

JP 49-062206 5/1974
JP 09-068197 3/1997

(Continued)

OTHER PUBLICATIONS

International Search Report dated Dec. 26, 2017 in International (PCT) Application No. PCT/JP2017/038021.

(Continued)

*Primary Examiner* — Igor Kershteyn
(74) *Attorney, Agent, or Firm* — Wenderoth, Lind & Ponack, L.L.P.

(57) ABSTRACT

An impeller includes a disk, a long blade that is disposed at an interval in a circumferential direction on a disk surface on a first side in an axial direction of the disk, and that reaches an outer peripheral edge of the disk, and a short blade that is disposed between the long blades adjacent to each other on the disk surface, and that reaches the outer peripheral edge. A circumferential length of the short blade gradually increases as the short blade faces outward in the radial direction, and a circumferential length of the long blade in the outer peripheral edge is smaller than the circumferential length of the short blade in the outer peripheral edge.

8 Claims, 4 Drawing Sheets

(56) References Cited

U.S. PATENT DOCUMENTS

| | | | | |
|---|---|---|---|---|
| 5,964,576 | A * | 10/1999 | Fujita | F04D 29/282 415/206 |
| 6,629,556 | B2 * | 10/2003 | Decker | B22C 7/02 164/35 |
| 7,179,050 | B2 * | 2/2007 | Hopfensperger | F04D 29/281 415/204 |
| 8,109,731 | B2 * | 2/2012 | Keber | F04D 29/023 416/186 R |
| 8,251,649 | B2 * | 8/2012 | Goto | F04D 29/661 415/191 |
| 9,719,523 | B2 * | 8/2017 | Jayaram | F04D 1/00 |
| 9,920,768 | B2 * | 3/2018 | Bruss | F04D 29/281 |
| 2004/0076513 | A1 | 4/2004 | Sishtla et al. | |
| 2014/0079558 | A1 | 3/2014 | Koivikko et al. | |
| 2017/0089355 | A1 * | 3/2017 | Niu | F04D 29/2216 |

FOREIGN PATENT DOCUMENTS

| | | |
|---|---|---|
| JP | 10-141290 | 5/1998 |
| JP | 2002-098094 | 4/2002 |
| JP | 2004-144087 | 5/2004 |
| JP | 2007-040210 | 2/2007 |

OTHER PUBLICATIONS

Written Opinion of the International Searching Authority dated Dec. 26, 2017 in International (PCT) Application No. PCT/JP2017/038021, with English-language translation.

* cited by examiner

IMPELLER AND ROTATING MACHINE

TECHNICAL FIELD

The present invention relates to an impeller and a rotating machine. Priority is claimed on Japanese Patent Application No. 2016-206998, filed on Oct. 21, 2016, the content of which is incorporated herein by reference.

BACKGROUND ART

As an example of a rotating machine, a centrifugal pump for pumping a fluid is widely used (refer to Patent Document 1 below). This centrifugal pump pumps the fluid by rotating an impeller having a plurality of blades. The impeller has a disk having a disk shape and the plurality of blades arranged at an interval in a circumferential direction on a disk surface which is a surface on the disk. An area of a flow path formed between a pair of adjacent blades gradually increases from an inner side toward an outer side in a radial direction of the disk.

CITATION LIST

Patent Literature

[Patent Document 1] Japanese Unexamined Patent Application, First Publication No. 2007-40210

SUMMARY OF INVENTION

Technical Problem

In the impeller as described above, in general, an area expansion ratio in a flow direction in the flow path between the blades is high. Accordingly, the fluid flowing in the flow path cannot follow a surface of the blade, and in some cases, flow separation may occur on the surface of the blade. In a case where the flow separation occurs in this way, not only an initially expected pump head cannot be obtained, but also efficiency of the centrifugal pump may be affected in some cases.

On the other hand, in a case where a blade thickness is unexpectedly widened on an outer peripheral side in order to suppress the flow separation, a weight increases on the outer peripheral side of the impeller. As a result, the increased weight may cause unbalanced vibrations in some cases. In addition, pulsation of discharge pressure tends to increase.

This problem arises not only in the centrifugal pump, but also in other rotating machines using the impeller.

According to the present invention, there are provided an impeller and a rotating machine which can reduce flow separation and can achieve stabilized rotation.

Solution to Problem

According to a first aspect of the present invention, there is provided an impeller including a disk having a disk shape centered on an axis, a long blade that is disposed at an interval in a circumferential direction on a disk surface on a first side in an axial direction of the disk, and that reaches an outer peripheral edge of the disk by extending toward the first side in the circumferential direction as the long blade faces outward in a radial direction, and a short blade that is disposed between the long blades adjacent to each other on the disk surface, and that reaches the outer peripheral edge by extending to the first side in the circumferential direction as the short blade faces outward in the radial direction, from a radially outer position of an inner side end portion of the long blade in the radial direction. A circumferential length of the short blade gradually increases as the short blade faces outward in the radial direction, and a circumferential length of the long blade in the outer peripheral edge is smaller than the circumferential length of the short blade in the outer peripheral edge.

The impeller includes both the short blade and the long blade. Accordingly, compared to a case of including only the long blade, it is possible to minimize an area enlargement ratio of the flow path formed between the long blades adjacent to each other. Therefore, it is possible to reduce possibilities that flow separation may occur on the surface of the long blade.

In addition, compared to a case of including only the short blade, it is possible to reduce a weight on the outer peripheral side. In this manner, not only unbalanced vibrations can be suppressed, but also pulsation of discharge pressure can be suppressed.

According to a second aspect of the present invention, in the long blade, a thickness of a radially outer portion from a throat position where a flow path width is narrowest between the long blade and the short blade adjacent to the long blade on a second side in the circumferential direction may be equal to or thinner than a thickness at the throat position.

According to this configuration, an increase in the weight of the long blade is suppressed, thereby improving balance of the impeller. Furthermore, interference between the long blade and a diffuser can be suppressed, and the pulsation of the discharge pressure can be reduced.

According to a third aspect of the present invention, the long blade may have a long blade pressure surface which faces the first side in the circumferential direction and a long blade suction surface which faces the second side in the circumferential direction. The short blade may have a short blade pressure surface which faces the first side in the circumferential direction and a short blade suction surface which faces the second side in the circumferential direction. When the circumferential length from a suction side of the long blade to a pressure side of the short blade on the outer peripheral edge of the disk is set to a flow path width on a side of the long blade suction surface and the circumferential length from a pressure side of the long blade to a suction side of the short blade is set to a flow path width on a side of the long blade pressure surface, the flow path width on the side of the long blade suction surface may be equal to or narrower than the flow path width on the side of the long blade pressure surface.

According to this configuration, since the short blade is located close to the side of the long blade pressure surface, it is possible to reduce a change in each flow path area of a throat formed between the long blades and a throat formed between the long blade suction surface and the short blade pressure surface. In this manner, it is possible to reduce a pressure loss when a fluid flows from the inside in the radial direction to the outside in the radial direction of the disk.

According to a fourth aspect of the present invention, a ratio between the flow path width on the side of the long blade pressure surface and the flow path width on the side of the long blade suction surface may fall within a range of 3:7 to 1:1.

According to this configuration, it is possible to further reduce the pressure loss of the fluid flowing from the inside in the radial direction to the outside in the radial direction.

According to a fifth aspect of the present invention, the blade length of the short blade may be 20% to 80% of a blade length of the long blade.

According to this configuration, when the short blade length is 20% to 80% of the long blade length, it is not inhibit to form the throat between the long blades adjacent to each other. Accordingly, since the interval between the long blades adjacent to each other on the outer peripheral edge increases, the flow separation can be prevented. Furthermore, it is more preferable to set the short blade length to 20% to 70% of the long blade length.

According to a sixth aspect of the present invention, when a width of the long blade on the outer peripheral edge is set to a long blade outlet width TL, a width of the short blade on the outer peripheral edge is set to a short blade outlet width TS, an outer diameter of the impeller is set to D, and the number of the long blades is set to Z, a relationship of $TL<TS<0.5\times\pi D/Z-TL$ may be satisfied.

According to this configuration, since the length of the short blade outlet width is set to be smaller than half of a length interval between the long blades adjacent to each other on the outer peripheral edge, the fluid can be circulated without excessively narrowing the flow path of the fluid flowing from the inside in the radial direction toward the outside in the radial direction.

According to a seventh aspect of the present invention, there is provided a rotating machine including a rotor that extends along an axis, the impeller that is attached to the rotor according to any one of aspects 1 to 6, and a casing that covers the impeller from an outer peripheral side.

According to the rotating machine having this configuration, it is possible to achieve operation effects which are the same as the above-described operation effects.

According to an eighth aspect of the present invention, the rotating machine may further include a diffuser that is disposed on the outer peripheral side of the impeller. The diffuser may include a diffuser blade whose blade thickness gradually increases from a leading edge to a trailing edge.

According to this configuration, since the blade thickness of the diffuser blade gradually increases from the leading edge to the trailing edge, excessive enlargement of the flow path can be suppressed even inside the diffuser, and the loss caused by the fluid separation can be suppressed. Furthermore, it is possible to suppress an increase in an unsteady fluid force or pressure pulsation caused by interference between the long blade and the diffuser.

According to a ninth aspect of the present invention, the rotating machine may further include a diffuser that is disposed on the outer peripheral side of the impeller. The diffuser may have a diffuser short blade whose blade thickness gradually increases from a leading edge to a trailing edge, and a diffuser long blade whose blade thickness is thinner than that of the trailing edge of the diffuser short blade.

According to this configuration, a structure can be simplified, compared to a shape in which the blade thickness of the whole diffuser blade gradually increases from the leading edge to the trailing edge. Therefore, cost reduction can be achieved.

Advantageous Effects of Invention

According to the above-described impeller and the above-described rotating machine, it is possible to reduce flow separation and to achieve stabilized rotation.

DESCRIPTION OF EMBODIMENTS

First Embodiment

A first embodiment according to the present invention will be described with reference to FIGS. 1 and 2.

Figure 1:
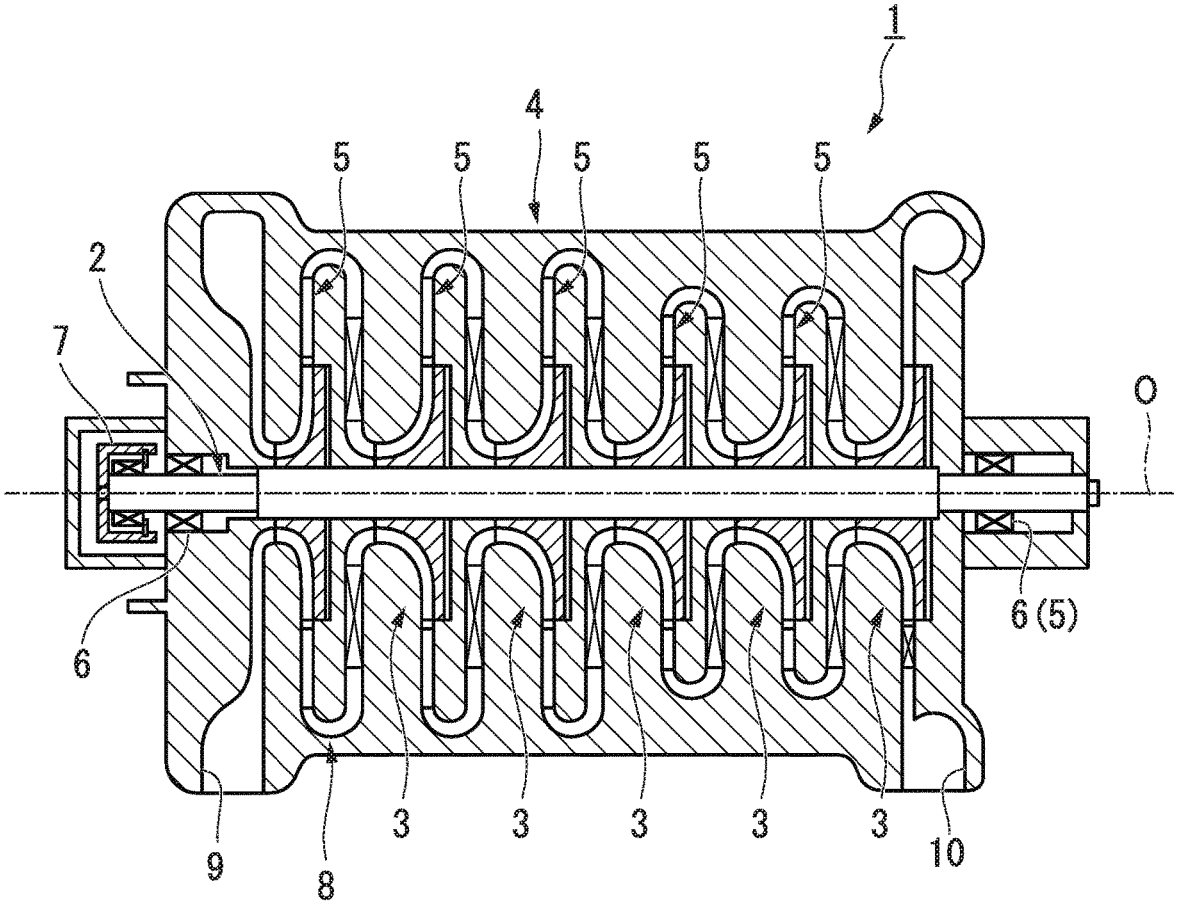
FIG. 1 is a schematic longitudinal sectional view of a rotating machine (pump) according to a first embodiment of the present invention.

As shown in FIG. 1, a centrifugal pump 1 includes a rotor 2 extending along an axis O, an impeller 3 attached to an outer peripheral portion of the rotor 2, a casing 4 for covering the rotor 2 and the impeller 3 from an outer peripheral side, and a diffuser 5.

The rotor 2 has a cylindrical shape centered on the axis O. A journal bearing 6 and a thrust bearing 7 are disposed in both side end portions of the rotor 2 in a direction of the axis O. The rotor 2 is supported so as to be rotatable around the axis O by these bearing devices. The journal bearing 6 is a bearing for supporting a load of the rotor 2 in a radial direction. The thrust bearing 7 is a bearing for supporting a load applied to the rotor 2 in a thrust direction (direction of the axis O).

The impeller 3 is fixed to the outer peripheral portion of the rotor 2 by means of interference fit, for example. That is, the impeller 3 is rotated integrally with the rotor 2 around the axis O.

The casing 4 internally accommodates the rotor 2 and the impeller 3, and forms a fluid flow path 8 for circulating a fluid. More specifically, an inner peripheral surface of the casing 4 repeatedly increases and decreases in diameter as the inner peripheral surface faces from the first side in the direction of the axis O (left side in FIG. 1) toward the second side in the direction of the axis O (right side in FIG. 1), thereby forming the above-described fluid flow path 8.

An inlet port 9 for leading the fluid from the outside is formed on the first side of the casing 4 in the direction of the axis O. On the other hand, a discharge port 10 for discharging the fluid pumped through the fluid flow path 8 is formed on the second side of the casing 4 in the direction of the axis O. In the following description, a side on which the inlet port 9 is located will be referred to as an upstream side, and a side on which the discharge port 10 is located will be referred to as a downstream side.

Then, the diffuser 5 is disposed on a fluid outlet side of each impeller 3 in the fluid flow path 8 formed by the casing 4.

Next, with reference to FIG. 2, a detailed configuration of the impeller 3 will be described. As shown in FIG. 2, the impeller 3 has a disk 11 having a disk shape centered on the axis O, a plurality of (three in the present embodiment) long blades 20 disposed on the first side of the disk 11 in the direction of the axis O, and a plurality of (three in the present embodiment) short blades 30.

A lead portion 12 for leading the fluid flowing through the above-described fluid flow path 8 is formed in a region including the center of a disk surface 11*a* facing the first side in the disk 11. The long blade 20 extends outward from the lead portion 12 in the radial direction. The long blade 20 has a long blade pressure surface 21 facing the first side (front side in a rotation direction of the impeller 3) in a circumferential direction, and a long blade suction surface 22 facing the second side (rear side in the rotation direction of the impeller 3) in the circumferential direction.

The short blade 30 extends outward in the radial direction until the short blade 30 reaches the outer peripheral edge from a radially outer position of a radially inner end portion of the long blade. The short blade 30 has a short blade pressure surface 31 facing the first side in the circumferential direction, and a short blade suction surface 32 facing the second side in the circumferential direction.

Furthermore, the long blade 20 is curved from the first side toward the second side in the circumferential direction as the long blade 20 faces outward in the radial direction from the inside in the radial direction with respect to the axis O. In this manner, the long blade pressure surface 21 has a projecting and curved surface shape which projects to the first side in the circumferential direction. The long blade suction surface 22 has a recessed and curved surface shape which is recessed toward the first side in the circumferential direction.

A length of the short blade 30 gradually increases in the circumferential direction as the short blade 30 faces outward in the radial direction from the inside in the radial direction. That is, a thickness of the short blade 30 increases toward a radially outer portion. An end portion on the outer peripheral side of the short blade 30 serves as a short blade outer peripheral portion 33 extending along the outer peripheral edge of the disk 11.

The long blades 20 and the short blades 30 which are configured in this way are alternately arranged three by three at an interval in the circumferential direction of the axis O. The number of the short blades 30 and the number of the long blades 20 may not be the same as each other, and the plurality of short blades may be arranged between the long blades adjacent to each other.

A space spreading in the circumferential direction is formed between the long blades 20 and the short blades 30 which are adjacent to each other. This space serves as an impeller flow path F for circulating the fluid leaded from the lead portion 12. A length of the impeller flow path F increases in the circumferential direction as the impeller flow path F faces outward from the inside in the radial direction. Furthermore, the impeller flow path F is curved from the first side toward the second side in the circumferential direction as the impeller flow path F faces outward from the inside in the radial direction.

Figure 3:
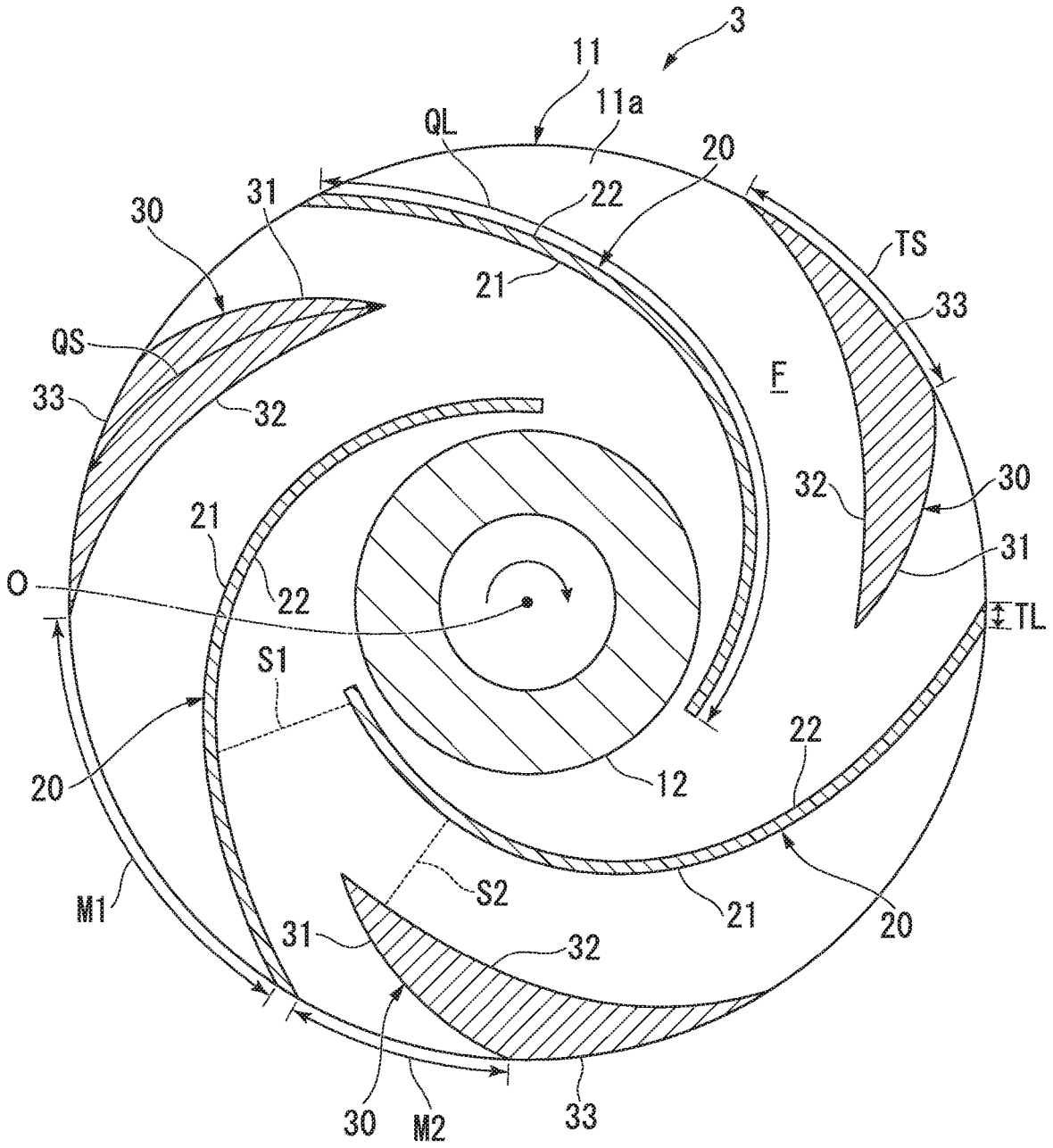
FIG. 3 is a sectional view perpendicular to an axis of the impeller and the diffuser according to the first embodiment of the present invention.

Next, a hub side (disk 11 side) of the long blade 20 and the short blade 30 in the impeller 3 will be described with reference to FIG. 3.

The long blades 20 are adjacent to each other in a portion where the short blade 30 is not formed in an inner peripheral portion of the impeller 3. A location where a flow path width is narrowest in the impeller flow path F between the long blades 20 adjacent to each other serves as a first throat position S1.

A location where the impeller flow path F is narrowest between the long blade 20 and the short blade 30 in a portion where the long blade 20 and the short blade 30 are adjacent to each other in the outer peripheral portion of the impeller 3 serves as a second throat position S2.

According to the present embodiment, the thickness of the long blade 20 gradually increases as the long blade 20 faces outward in the radial direction from the inner end portion in the radial direction, and is thickest at the second throat position S2. Then, the thickness in a radially outer portion from the second throat position S2 is thinner than the thickness at the second throat position S2. In particular, according to the present embodiment, the thickness of the long blade 20 gradually decreases as the long blade 20 faces outward in the radial direction from the second throat position S2.

Here, the length interval in the outer peripheral edge of the disk 11 between the long blade pressure surface 21 and the short blade suction surface 32 which are adjacent to each other is set to a flow path width M1 on the side of the long blade pressure surface. The length interval in the outer peripheral edge of the disk 11 between the long blade suction surface 22 and the short blade pressure surface 31 is set to a flow path width M2 on the side of the long blade suction surface. According to the present embodiment, the flow path width M2 is set to be equal to or narrower than the flow path width M1.

Furthermore, it is preferable that a ratio of the flow path widths between the flow path width M1 on the side of the long blade pressure surface and the flow path width M2 on the side of the long blade suction surface is 3:7 to 1:1. The fluid circulated through the impeller flow path F is likely to flow along the long blade suction surface 22. Accordingly, since the flow path width M1 on the side of the long blade pressure surface is set to be narrower than the flow path width M2 on the side of the long blade suction surface, the fluid is likely to be uniformly distributed to each region having the flow path width M1 and the flow path width M2.

In addition, the entire length of the long blade 20 (length along a center line of the long blade 20) is set to a long blade length QL, and the length of the center line of the short blade 30 (length along the center line of the short blade) is set to a short blade length QS. Here, the center line is line segment configured to connect points where distances from the pressure side and the suction side are the same at each circumferential position in a range where the pressure side and the suction side reach the outside from the inside in the radial direction.

It is preferable that an innermost portion of the short blade 30 in the radial direction does not enter the first throat position. In this manner, the fluid is likely to flow in the impeller flow path F formed between the long blade 20 and the adjacent short blade 30. In addition, it is more preferable that the short blade length QS is equal to or shorter than 80% of the long blade length QL. Furthermore, if the length of the short blade length QS is equal to or longer than 20% of the long blade length, the fluid flowing along the surface of the long blade 20 is less likely to be separated. Therefore, it is preferable that the short blade length QS is 20% to 80% of the long blade length QL.

The interval between the long blade 20 and the short blade 30 may be set using each width of the long blade 20 and the short blade 30 on the outer peripheral edge of the disk 11. Here, the width of the long blade 20 on the outer peripheral edge of the disk 11 is set to a long blade outlet width TL, the width of the short blade 30 on the outer peripheral edge of the disk 11 is set to a short blade outlet width TS, an outer diameter (outer diameter of the disk 11) of the impeller 3 is set to D, and the number of the long blades 20 is set to Z.

In this case, it is preferable that a relationship of $TL<TS<0.5\times\pi D/Z-TL$ is satisfied. In this manner, fluid separation from the surface of the long blade 20 can be suppressed.

Next, an operation of the centrifugal pump 1 and the impeller 3 will be described. When the centrifugal pump 1 is operated, the rotor 2 is first driven to be rotated around the axis O by using a drive source (not shown). As the rotor 2 is rotated, the impeller 3 integrally disposed on the rotor 2 is also rotated. The rotation of the impeller 3 causes an external fluid to be leaded into the fluid flow path 8 through the inlet port 9. In this case, the pressure of the fluid rises while passing through the impeller flow path F formed in the impeller 3. Here, according to the present embodiment, six impellers 3 are disposed in the centrifugal pump. That is, while the pressure is sequentially raised by the six impellers 3, the fluid is pumped from the upstream side toward the downstream side. Thereafter, the fluid having high pressure is discharged outward from the discharge port 10 disposed on the downstream side of the casing 4. During the operation of the pump, the above-described cycle is continuously repeated.

Subsequently, flow movement of the fluid inside the impeller flow path F will be described. As shown in the drawing, during the operation of the centrifugal pump 1, the impeller 3 is rotated from the second side toward the first side in the circumferential direction. As the impeller 3 is rotated, the fluid flowing into the impeller flow path F from the lead portion 12 of the disk 11 flows outward from the inside in the radial direction along the impeller flow path F.

Here, a configuration is adopted to include only the long blade 20 without disposing the short blade 30. In a case where the length in the circumferential direction of the long blade 20 is equal throughout an entire region in the radial direction, the flow path between the long blades 20 is larger than that in a case where the length in the circumferential direction of the long blade 20 gradually increases. In particular, as the flow path faces outward in the radial direction, the length in the circumferential direction of the flow path increases. That is, an area enlargement ratio increases in a region between the long blades 20. In this way, in a case where the area enlargement ratio is high, the fluid flowing outward from the inside in the radial direction cannot follow the surface of the long blade 20, thereby causing a possibility that the flow separation may occur on the surface. In a case where the flow separation occurs, not only a desired pump head cannot be obtained, but also efficiency of the centrifugal pump 1 may be affected in some cases.

On the other hand, in a case where the length in the long blade 20 gradually increases outward in the radial direction from the inside in the radial direction, the problem that the fluid cannot follow the surface of the long blade 20 can be solved. However, as the long blade 20 is disposed closer to the outer peripheral edge, the weight increases. Therefore, the increased weight may cause unbalanced vibrations, and moreover, the pulsation of the discharge pressure is likely to occur.

In contrast, in the impeller 3 according to the present embodiment, the short blade 30 is disposed between the long blades 20 adjacent to each other. In this manner, compared to a case where the length of only the long blade 20 in the circumferential direction is equal throughout the region in the radial direction, it is possible to minimize the area enlargement ratio (area enlargement ratio from the inside to the outside in the radial direction) of the flow path formed between the long blades 20. Furthermore, compared to a case where the length of the long blade 20 gradually increases outward from the inside in the radial direction, the weight can be reduced, and the unbalanced vibrations of the impeller can be suppressed. Therefore, it is possible to reduce the flow separation or the pulsation of the discharge pressure on the surface of the long blade 20 and the short blade 30, and it is possible to improve the efficiency of the centrifugal pump 1.

Figure 2:
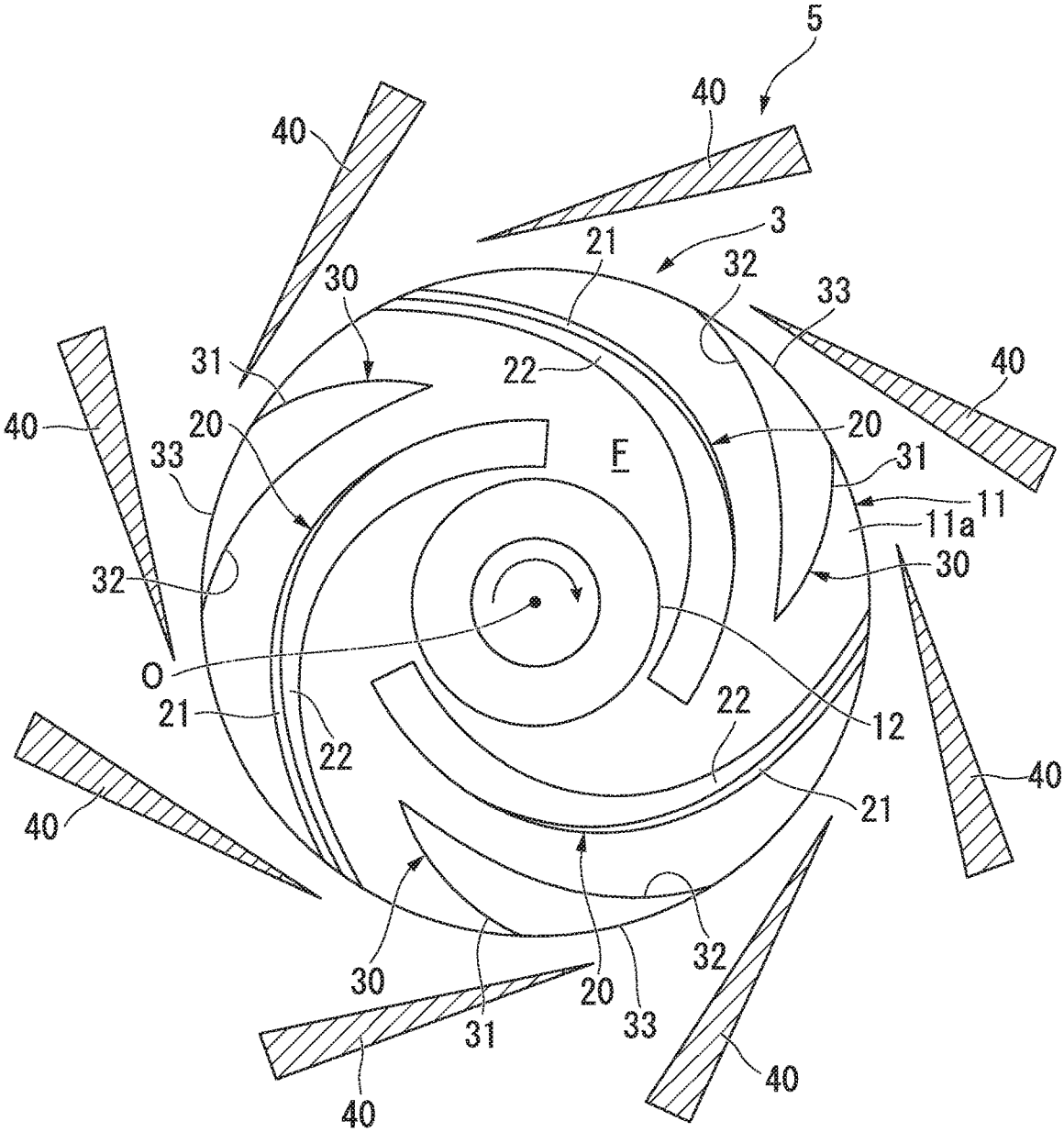
FIG. 2 is a view when an impeller and a diffuser according to the first embodiment of the present invention are viewed in an axial direction.

Here, as shown in FIGS. 1 and 2, the diffuser 5 is disposed on the outer peripheral side of the impeller 3, and is located so as to allow the inner peripheral side and the outer peripheral side of the diffuser 5 to communicate with each other. In the diffuser 5, a passage formed by the diffuser blades 40 adjacent to each other decelerates the speed of the fluid flowing from the impeller 3. The diffuser blade 40 has a required spread, and is located at a proper position in the circumferential direction in accordance with a direction in which the fluid flows out from the impeller 3.

The diffuser blade 40 is fixed onto the casing 4. According to the present embodiment, the impeller 3 is configured to include a total six blades such as three long blades 20 and three short blades 30. The diffuser 5 is configured to include seven or eight diffuser blades 40 which gradually increase from the leading edge to the trailing edge.

In a case where the leading edge of the diffuser blade 40 is located inward in the radial direction and the trailing edge is located outward in the radial direction, the diffuser blade 40 is formed so that the blade thickness of the diffuser blade 40 gradually increases from the leading edge to the trailing edge of the diffuser blade 40. In this manner, it is possible to suppress the fluid separation caused by a rapid increase in the flow path in the diffuser 5, and it is possible to efficiently raise the pressure of the fluid.

Furthermore, an arrangement is made so that there is no common divisor in the total number of blades of the impeller 3 and the number of the diffuser blades 40. In this manner, it is possible to reduce possibilities that two streams may pass through the rotor blade and the stator blade at the same time when the streams are viewed at a certain timing.

Second Embodiment

Next, a second embodiment according to the present invention will be described with reference to FIG. 4. The same reference numerals will be given to configurations which are the same as those according to the above-described embodiment, and detailed description thereof will be omitted.

Figure 4:
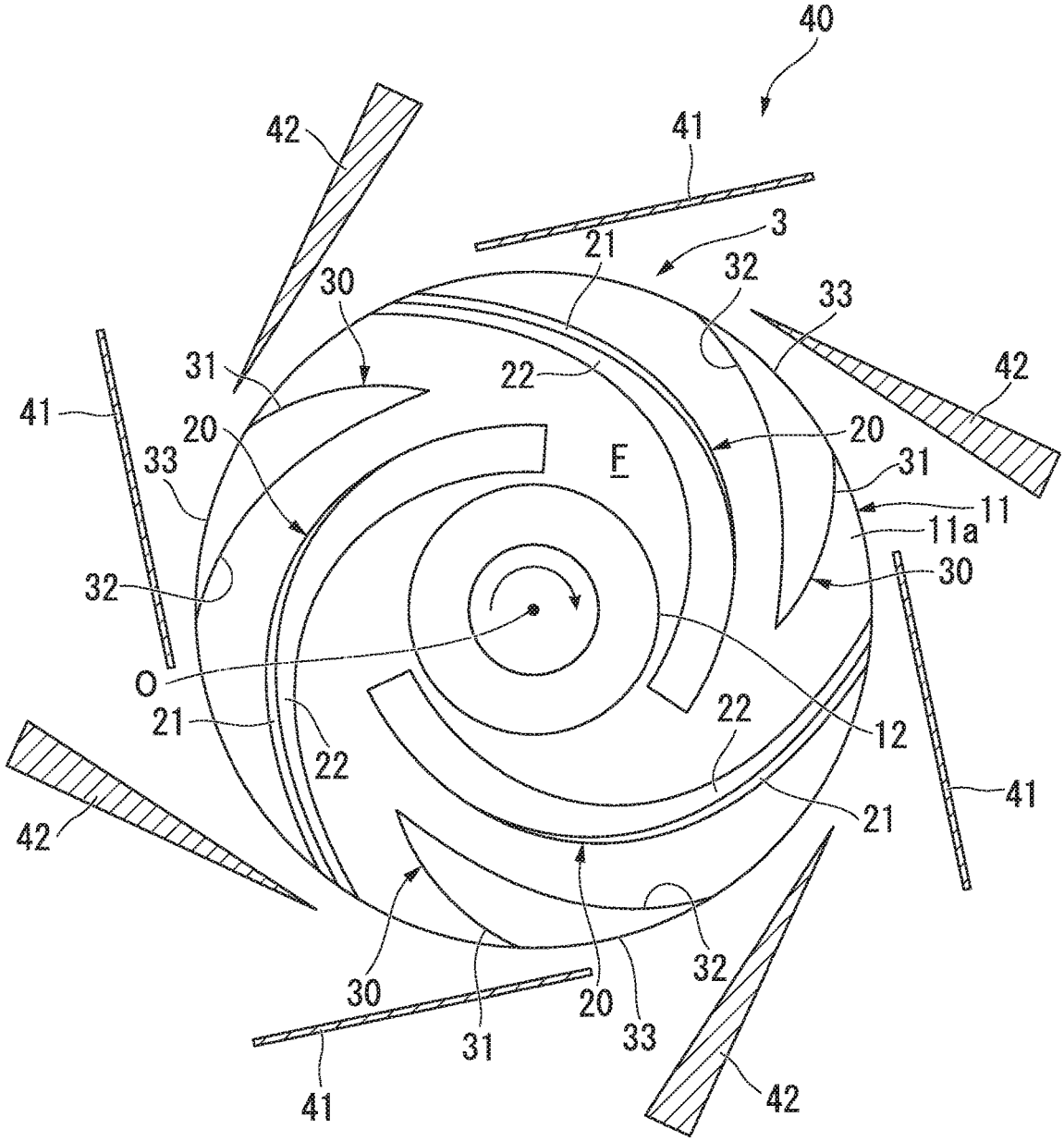
FIG. 4 is a view when an impeller and a diffuser according to a second embodiment of the present invention are viewed in the axial direction.

As shown in FIG. 4, the diffuser 5 according to the present embodiment includes diffuser long blades 41 which are disposed on the casing 4 so as to protrude outward in the radial direction from the inside in the radial direction and whose blade thicknesses are the same as each other, and diffuser short blades 42 whose blade thickness gradually increases from the leading edge to the trailing edge.

The fluid whose speed is raised by the impeller 3 is leaded into the diffuser 5, and the pressure of the fluid is raised while the speed is lowered. In this case, since the diffuser long blades 41 having a smaller blade thickness than the diffuser short blade 42 are alternately arranged, the fluid separation can be suppressed similarly to the first embodiment.

Furthermore, it is possible to reduce the weight of the centrifugal pump 1 by forming the shape of the diffuser long blade 41 to have a thinner blade thickness than the diffuser short blade 42. In addition, the diffuser long blade 41 is thinner than the diffuser short blade 42 whose blade thickness gradually increases. Accordingly, it is possible to reduce the manufacturing cost.

Hitherto, the embodiments according to the present invention have been described in detail with reference to the drawings. However, specific configurations are not limited to the embodiments, and include any design change within the scope not departing from the gist of the present invention.

According to the above-described embodiments, the number of blades of the impeller 3 is set to 6, and the number of the diffuser blade is set to 7 or 8. However, the present invention is not limited thereto.

In addition, according to the above-described embodiments, the impeller 3 is a so-called open impeller having no cover. However, the impeller 3 may be a closed impeller having a cover.

Furthermore, according to the above-described embodiments, the centrifugal pump 1 has been described as an example of the rotating machine. However, the present invention may be applicable to other rotating machines.

INDUSTRIAL APPLICABILITY

According to the impeller and the rotating machine, it is possible to reduce flow separation and to achieve stabilized rotation.

REFERENCE SIGNS LIST

1: centrifugal pump
2: rotor
3: impeller
4: casing
5: diffuser
6: journal bearing
7: thrust bearing
8: fluid flow path
9: inlet port
10: discharge port
11: disk
11*a*: disk surface
12: lead portion
20: long blade
21: long blade pressure surface
22: long blade suction surface
30: short blade
31: short blade pressure surface
32: short blade suction surface
33: short blade outer peripheral portion
40: diffuser blade
41: diffuser long blade
42: diffuser short blade
O: axis
F: impeller flow path
S1: first throat position
S2: second throat position
QL: long blade length
QS: short blade length

The invention claimed is:

1. An impeller comprising:

a disk having a disk shape centered on an axis;

a long blade that is disposed at an interval in a circumferential direction on a disk surface on a first side in an axial direction of the disk, and that reaches an outer peripheral edge of the disk by extending toward the first side in the circumferential direction as the long blade faces outward in a radial direction; and a short blade that is disposed between the long blades adjacent to each other on the disk surface, and that reaches the outer peripheral edge by extending to the first side in the circumferential direction as the short blade faces outward in the radial direction, from a radially outer position of an inner side end portion of the long blade in the radial direction, wherein a circumferential length of the short blade gradually increases as the short blade faces outward in the radial direction, wherein a circumferential length of the long blade in the outer peripheral edge is smaller than the circumferential length of the short blade in the outer peripheral edge, wherein a location where a flow path width is narrowest between the long blade and the short blade in a portion where the long blade and the short blade are adjacent to each other is a second throat position, wherein a thickness of the long blade gradually increases outward in the radial direction from an inner end portion in the radial direction, and is thickest at the second throat position, and wherein the thickness of the long blade in a radially outer portion from the second throat position is thinner than the thickness of the long blade at the second throat position.

2. The impeller according to claim 1, wherein the long blade has a long blade pressure surface which faces the first side in the circumferential direction and a long blade suction surface which faces the second side in the circumferential direction, wherein the short blade has a short blade pressure surface which faces the first side in the circumferential direction and a short blade suction surface which faces the second side in the circumferential direction, and wherein when a circumferential length from a suction side of the long blade to a pressure side of the short blade on the outer peripheral edge of the disk is set to a flow path width on a side of the long blade suction surface and a circumferential length from a pressure side of the long blade to a suction side of the short blade is set to a flow path width on a side of the long blade pressure surface, the flow path width on the side of the long blade suction surface is equal to or narrower than the flow path width on the side of the long blade pressure surface.

3. The impeller according to claim 2, wherein a ratio between the flow path width on the side of the long blade pressure surface and the flow path width on the side of the long blade suction surface falls within a range of 3:7 to 1:1.

4. The impeller according to claim 1, wherein a blade length of the short blade is 20% to 80% of a blade length of the long blade.

5. The impeller according to claim 1, wherein when a width of the long blade on the outer peripheral edge is set to a long blade outlet width TL, a width of the short blade on the outer peripheral edge is set to a short blade outlet width TS, an outer diameter of the impeller is set to D, and the number of the long blades is set to Z, a relationship of $TL<TS<0.5\times\pi D/Z-TL$ is satisfied.

6. A rotating machine comprising:

a rotor that extends along an axis;

the impeller that is attached to the rotor according to claim 1; and a casing that covers the impeller from an outer peripheral side.

7. The rotating machine according to claim 6, further comprising:

a diffuser that is disposed on the outer peripheral side of the impeller, wherein the diffuser has a diffuser blade whose blade thickness gradually increases from a leading edge to a trailing edge.

8. The rotating machine according to claim 6, further comprising:

a diffuser that is disposed on the outer peripheral side of the impeller, wherein the diffuser has a diffuser short blade whose blade thickness gradually increases from a leading edge to a trailing edge, and a diffuser long blade whose blade thickness is thinner than that of the trailing edge of the diffuser short blade.

* * * * *